US011302261B2

(12) United States Patent
Kim et al.

(10) Patent No.: US 11,302,261 B2
(45) Date of Patent: Apr. 12, 2022

(54) DISPLAY APPARATUS AND METHOD OF DRIVING DISPLAY PANEL USING THE SAME

(71) Applicant: Samsung Display Co., Ltd., Yongin-Si (KR)

(72) Inventors: Jinpil Kim, Suwon-si (KR); Namjae Lim, Gwacheon-si (KR); Hoisik Moon, Hwaseong-si (KR); Jae Sung Bae, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/833,734

(22) Filed: Mar. 30, 2020

(65) Prior Publication Data

US 2020/0410940 A1 Dec. 31, 2020

(30) Foreign Application Priority Data

Jun. 27, 2019 (KR) ..... 10-2019-0077330

(51) Int. Cl.
*G09G 3/3275* (2016.01)
*G09G 3/36* (2006.01)

(52) U.S. Cl.
CPC ..... *G09G 3/3275* (2013.01); *G09G 3/3688* (2013.01); *G09G 2310/027* (2013.01); *G09G 2320/0233* (2013.01)

(58) Field of Classification Search
CPC ..... G09G 2300/026; G09G 2310/0232; G09G 2320/0233; G09G 2320/0285; G09G 2320/0242; G09G 2320/0693; G09G 2320/0271; G09G 3/2003; G09G 3/3648; G09G 3/3426; G09G 2360/16
See application file for complete search history.

(56) References Cited

U.S. PATENT DOCUMENTS 6,181,392 B1 * 1/2001 Greene ..... G06F 3/147 349/74
2010/0053450 A1 * 3/2010 Hanamura ..... G06F 3/1446 348/687
2010/0128053 A1 * 5/2010 Kato ..... G09G 5/10 345/589

(Continued)

FOREIGN PATENT DOCUMENTS

JP 4603747 B2 12/2010
KR 10-2019-0009022 A 1/2019

*Primary Examiner* — Dong Hui Liang
(74) *Attorney, Agent, or Firm* — Innovation Counsel LLP

(57) ABSTRACT

A display apparatus includes a display panel, a driving controller and a data driver. The display panel is configured to display an image. The driving controller is configured to generate a compensated image data for compensating a decrease of a luminance of an edge portion of the display panel based on input image data. The data driver is configured to output a data voltage to the display panel based on the compensated image data. The driving controller is configured to generate the compensated image data by comparing a maximum value among subpixel grayscale values of the input image data to which a luminance compensating coefficient is applied and a maximum grayscale value of the input image data. The luminance compensating coefficient is configured to be determined according to a location in the display panel.

10 Claims, 11 Drawing Sheets

(56) References Cited

U.S. PATENT DOCUMENTS

| | | | | |
|---|---|---|---|---|
| 2011/0285758 | A1* | 11/2011 | Matsushita | G09G 5/10 345/690 |
| 2012/0112991 | A1* | 5/2012 | Hashimoto | G09G 3/3413 345/89 |
| 2013/0106901 | A1* | 5/2013 | Inada | G09G 5/026 345/600 |
| 2013/0321497 | A1* | 12/2013 | Kang | G09G 3/3648 345/694 |
| 2016/0125787 | A1* | 5/2016 | Pyeon | G09G 3/3233 345/691 |
| 2016/0179453 | A1* | 6/2016 | Jepsen | G09G 3/002 345/690 |
| 2018/0040271 | A1* | 2/2018 | Jung | G09G 3/2007 |
| 2018/0146572 | A1 | 5/2018 | Park et al. | |
| 2018/0348925 | A1 | 12/2018 | Wang et al. | |
| 2019/0019474 | A1 | 1/2019 | Jun et al. | |

* cited by examiner

DISPLAY APPARATUS AND METHOD OF DRIVING DISPLAY PANEL USING THE SAME

PRIORITY STATEMENT

This application claims priority under 35 U.S.C. § 119 to Korean Patent Application No. 10-2019-0077330, filed on Jun. 27, 2019 in the Korean Intellectual Property Office (KIPO), the contents of which are herein incorporated by reference in their entireties.

BACKGROUND

1. Field

Embodiments of the present inventive concept relate to a display apparatus. More particularly, embodiments of the present inventive concept relate to a display apparatus and a method of driving a display panel using the display apparatus.

2. Description of the Related Art

A display apparatus, such as a liquid crystal display ("LCD") apparatus, an organic light emitting diode ("OLED") display apparatus, a light emitting diode ("LED") display apparatus and an inorganic emitting display (a quantum dots display), may include a display panel and a display panel driver. The display panel includes a plurality of gate lines, a plurality of data lines and a plurality of pixels connected to the gate lines and the data lines. The display panel driver includes a gate driver providing gate signals to the gate lines and a data driver providing data voltages to the data lines.

The LCD apparatus includes a first substrate including a pixel electrode, a second substrate including a common electrode and a liquid crystal layer disposed between the first substrate and the second substrate. An electric field is generated at the liquid crystal layer by voltages applied to the pixel electrode and the common electrode. By adjusting an intensity of the electric field, a transmittance of a light passing through the liquid crystal layer may be adjusted so that a desired image may be displayed.

The OLED display apparatus displays images using an OLED. The OLED generally includes an emitting layer between two electrodes, i.e., an anode electrode and a cathode electrode. Holes from the anode electrode may be combined with electrons from the cathode electrode in the emitting layer between the anode electrode and the cathode electrode to emit light.

Recently, a tiled display apparatus is used as a big display apparatus by integrating a plurality of display apparatus for displaying an ultra high resolution image. The tiled display apparatus includes bezels disposed between the plurality of the display apparatuses.

SUMMARY OF THE INVENTIVE CONCEPT

Embodiments of the present inventive concept provide a display apparatus capable of improving display quality.

Embodiments of the present inventive concept provide a method of driving a display panel using the display apparatus.

In some embodiments of a display apparatus according to the present inventive concept, the display apparatus includes a display panel, a driving controller and a data driver. The display panel is configured to display an image. The driving controller is configured to generate a compensated image data for compensating a decrease of a luminance of an edge portion of the display panel based on input image data. The data driver is configured to output a data voltage to the display panel based on the compensated image data. The driving controller is configured to generate the compensated image data by comparing a maximum value among subpixel grayscale values of the input image data to which a luminance compensating coefficient is applied and a maximum grayscale value of the input image data. The luminance compensating coefficient is configured to be determined according to a location in the display panel.

In some embodiments, the driving controller may be configured to determine a first luminance compensating coefficient of a first outermost area of the display panel, to apply the first luminance compensating coefficient to subpixel grayscale values of the first outermost area, to determine a first maximum value which is a maximum value among the subpixel grayscale values of the first outermost area to which the first compensation coefficient is applied, and to compare the first maximum value and the maximum grayscale value of the input image data.

In some embodiments, when the first maximum value is greater than the maximum grayscale value of the input image data, the driving controller may be configured to determine a first compensation ratio as (the maximum grayscale value of the input image data)/(the first maximum value).

In some embodiments, when the first maximum value is equal to or less than the maximum grayscale value of the input image data, the driving controller may be configured to determine the first compensation ratio as 1.

In some embodiments, the driving controller may be configured to multiply the first luminance compensating coefficient and the first compensation ratio to the subpixel grayscale values of the first outermost area to generate the compensated image data.

In some embodiments, the driving controller may be configured to determine a second luminance compensating coefficient of a second outermost area of the display panel, to apply the second luminance compensating coefficient to subpixel grayscale values of the second outermost area, to determine a second maximum value which is a maximum value among the subpixel grayscale values of the second outermost area to which the second compensation coefficient is applied, and to compare the second maximum value and the maximum grayscale value of the input image data. The second outermost area of the display panel may be adjacent to the first outermost area of the display panel and may be closer to a center of the display panel than the first outermost area.

In some embodiments, when the second maximum value is greater than the maximum grayscale value of the input image data, the driving controller may be configured to determine a second compensation ratio as (the maximum grayscale value of the input image data)/(the second maximum value).

In some embodiments, when the second maximum value is equal to or less than the maximum grayscale value of the input image data, the driving controller may be configured to determine the second compensation ratio as 1.

In some embodiments, the driving controller may be configured to multiply the second luminance compensating coefficient and the second compensation ratio to the subpixel grayscale values of the second outermost area to generate the compensated image data.

In some embodiments, the driving controller may be configured to determine a second luminance compensating coefficient of a second outermost area of the display panel. The second outermost area of the display panel may be adjacent to the first outermost area of the display panel and may be closer to a center of the display panel than the first outermost area. The driving controller may be configured to determine a second compensation ratio by multiplying ((the second luminance compensating coefficient)/(the first luminance compensating coefficient)) to the first compensation ratio.

In some embodiments, the driving controller may be configured to multiply the second luminance compensating coefficient and the second compensation ratio to the subpixel grayscale values of the second outermost area to generate the compensated image data.

In some embodiments, when the first maximum value is greater than the maximum grayscale value of the input image data, the driving controller may be configured to determine a first compensation grayscale difference as a difference between the maximum grayscale value and a first prior maximum value which is a maximum value among the subpixel grayscale values of the first outermost area in which the first luminance compensating coefficient is not applied.

In some embodiments, when the first maximum value is greater than the maximum grayscale value of the input image data, the driving controller may be configured to add the first compensation grayscale difference to the subpixel grayscale values of the first outermost area to generate the compensated image data.

In some embodiments, when the first maximum value is equal to or less than the maximum grayscale value of the input image data, the driving controller may be configured to generate the compensated image data using the subpixel grayscale values of the first outermost area to which the first luminance compensating coefficient is applied.

In some embodiments, the driving controller may be configured to determine a second luminance compensating coefficient of a second outermost area of the display panel, to apply the second luminance compensating coefficient to subpixel grayscale values of the second outermost area, to determine a second maximum value which is a maximum value among the subpixel grayscale values of the second outermost area to which the second compensation coefficient is applied, and to compare the second maximum value and the maximum grayscale value of the input image data. The second outermost area of the display panel may be adjacent to the first outermost area of the display panel and may be closer to a center of the display panel than the first outermost area.

In some embodiments, when the second maximum value is greater than the maximum grayscale value of the input image data, the driving controller may be configured to determine a second compensation grayscale difference as a difference between the maximum grayscale value and a second prior maximum value which is a maximum value among the subpixel grayscale values of the second outermost area in which the second luminance compensating coefficient is not applied.

In some embodiments, when the second maximum value is greater than the maximum grayscale value of the input image data, the driving controller may be configured to add the second compensation grayscale difference to the subpixel grayscale values of the second outermost area to generate the compensated image data.

In some embodiments, when the second maximum value is equal to or less than the maximum grayscale value of the input image data, the driving controller may be configured to generate the compensated image data using the subpixel grayscale values of the second outermost area to which the second luminance compensating coefficient is applied.

In some embodiments, the driving controller may be configured to determine a second luminance compensating coefficient of a second outermost area of the display panel. The second outermost area of the display panel may be adjacent to the first outermost area of the display panel and may be closer to a center of the display panel than the first outermost area. The driving controller may be configured to determine a second compensation grayscale difference by multiplying ((the second luminance compensating coefficient)/(the first luminance compensating coefficient)) to the first compensation grayscale difference.

In some embodiments, the driving controller may be configured to add the second compensation grayscale difference to the subpixel grayscale values of the second outermost area to generate the compensated image data.

In some embodiments of a method of driving a display panel according to the present inventive concept, the method includes determining a luminance compensating coefficient for compensating a decrease of a luminance of an edge portion of the display panel, comparing a maximum value among subpixel grayscale values of input image data to which the luminance compensating coefficient is applied and a maximum grayscale value of the input image data, generating compensated image data based on a result of comparing the maximum value among subpixel grayscale values of input image data to which the luminance compensating coefficient is applied and the maximum grayscale value of the input image data and outputting a data voltage to the display panel based on the compensated image data. The luminance compensating coefficient is configured to be determined according to a position in the display panel.

According to the display apparatus and the method of driving the display panel, image data of an edge portion of the display panel are compensated based on an actual decrease ratio of luminance of the edge portion of the display panel so that the decrease of the luminance of the edge portion of the display panel may be compensated.

In addition, when the decrease of the luminance of the edge portion of the display panel is compensated, a compensation ratio and a compensation grayscale difference are determined using a maximum value of the grayscale values of the subpixels so that a color may not be largely altered.

The bezel width perceived by a user may be decreased and the color may not be largely altered when compensating the luminance so that the display quality of the display panel may be enhanced.

BRIEF DESCRIPTION OF THE DRAWINGS

The above and other features and advantages of the present inventive concept will become more apparent by describing in detailed embodiments thereof with reference to the accompanying drawings, in which.

DETAILED DESCRIPTION OF THE INVENTIVE CONCEPT

Figure 1:
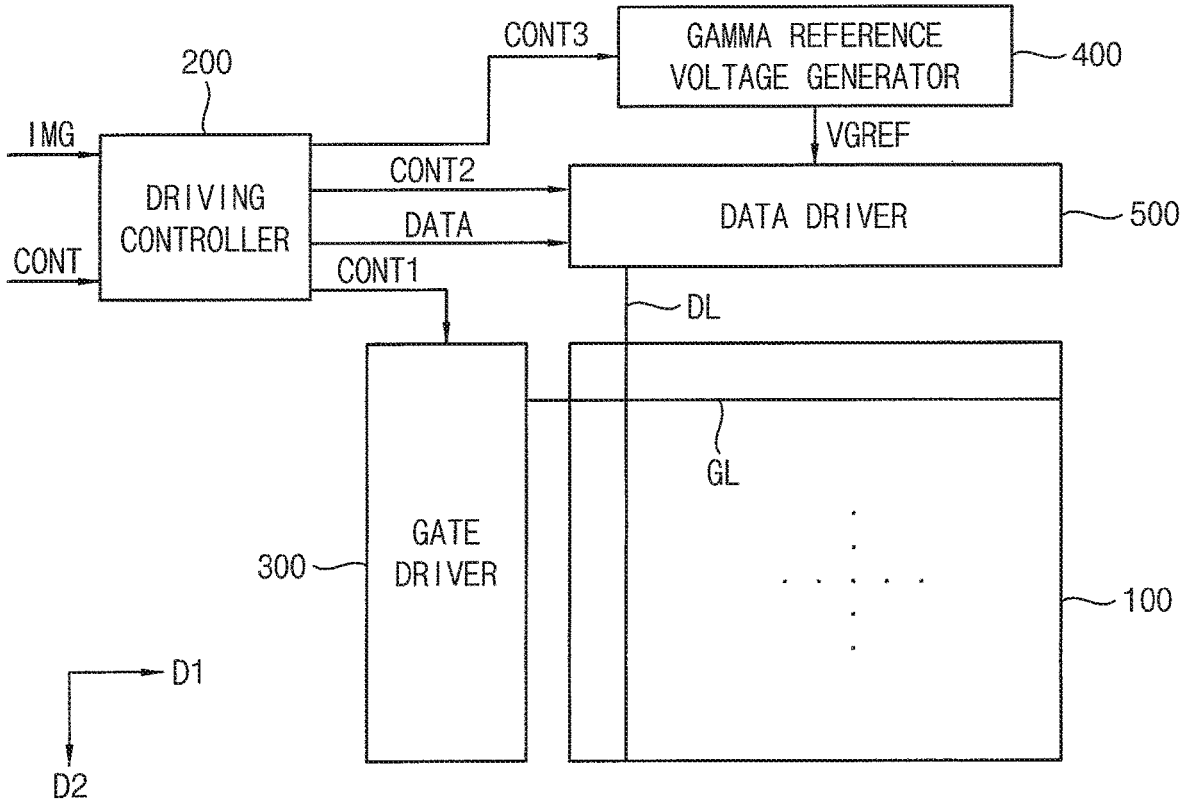
FIG. 1 is a block diagram illustrating a display apparatus according to an embodiment of the present inventive concept.

Hereinafter, the embodiments will be described in more detail with reference to the accompanying drawings. The present inventive concept will be explained in detail with reference to the accompanying drawings, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display apparatus according to an embodiment of the present inventive concept.

Referring to FIG. 1, a display apparatus may include a display panel and a display panel driver. The display panel driver may include a driving controller 200, a gate driver 300, a gamma reference voltage generator 400, and a data driver 500.

The display panel 100 may include a display region that displays an image and a peripheral region disposed adjacent to the display region.

The display panel 100 may include a plurality of gate lines GL, a plurality of data lines DL, and a plurality of pixels electrically connected to the gate lines GL and the data lines DL. The gate lines GL extend in a first direction D1 and the data lines DL extend in a second direction D2 crossing the first direction D1.

Each of the pixels may include a plurality of subpixels. In some embodiments, each of the pixels may include a red subpixel, a green subpixel, and a blue subpixel. In some embodiments, the pixels disposed in an edge portion of a screen may include a white subpixel. Alternatively, each of the pixels may include a magenta subpixel, a yellow subpixel, and a cyan subpixel. Although the pixel is mainly illustrated to include the red subpixel, the green subpixel and the blue subpixel in the embodiments, the present inventive concept may not be limited to the colors of the subpixels illustrated.

The driving controller 200 may receive input image data IMG and an input control signal CONT from an external device, for example, a graphic controller (not shown). The input image data IMG may be substantially the same as input image signals. The input image data IMG may include red image data R, green image data G and blue image data B. Each of the red image data R, green image data G, and the blue image data B may have a predetermined grayscale value, for example, between zero to 255. The grayscale value of the input image data IMG may represent as (R, G, B). Alternatively, the input image data IMG may include white image data. Alternatively, the input image data IMG may include magenta image data, yellow image data and cyan image data. The input control signal CONT may include a data enable signal and a master clock signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500. The data signal DATA may be substantially the same image data as the input image data IMG or the data signal DATA may be compensated image data generated by compensating the input image data IMG. For example, the driving controller 200 may selectively perform an image quality compensation, a stain compensation, an adaptive color correction ("ACC"), and/or a dynamic capacitance compensation ("DCC") on the input image data IMG to generate the data signal DATA.

For example, the driving controller 200 may compensate the input image data IMG in order to compensate a luminance decrease in the edge portion of the screen. In this case, the driving controller 200 generates the data signal DATA based on the compensated input image data.

The compensation of the input image data IMG will be explained in detail with reference to FIGS. 5 to 9.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1 received from the driving controller 200. The gate driver 300 outputs the gate signals to the gate lines GL.

The gamma reference voltage generator 400 generates a gamma reference voltage VGREF in response to the third control signal CONT3 received from the driving controller 200. The gamma reference voltage generator 400 outputs the gamma reference voltage VGREF to the data driver 500. The level of the gamma reference voltage VGREF corresponds to grayscales of a plurality of pixel data included in the data signal DATA.

In some embodiments, the gamma reference voltage generator 400 may be disposed in the driving controller 200, or may be disposed in the data driver 500.

The data driver 500 receives the second control signal CONT2 and the data signal DATA from the driving controller 200, and receives the gamma reference voltage VGREF from the gamma reference voltage generator 400. The data driver 500 converts the data signal DATA to analogue data voltages based on the gamma reference voltage VGREF. The data driver 500 outputs the data voltages to the data lines DL.

Figure 2:
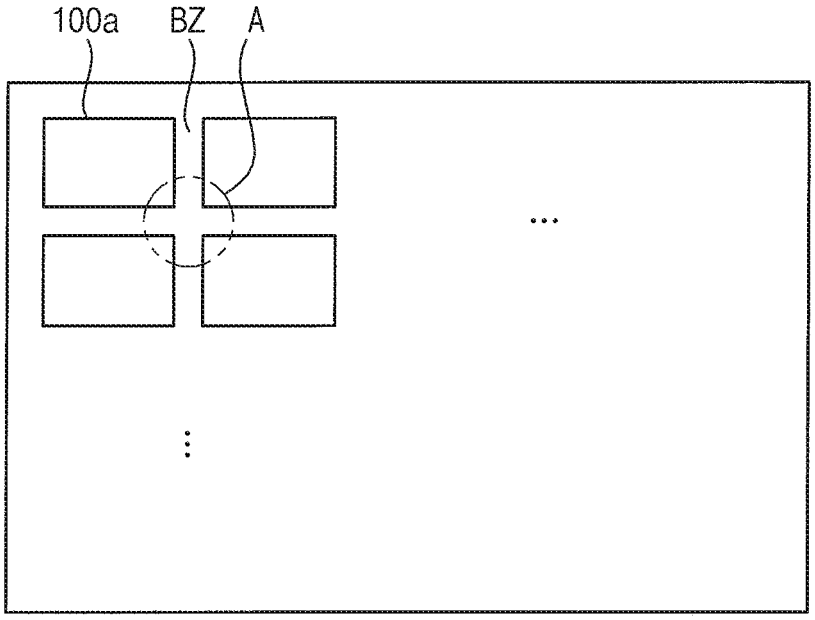
FIG. 2 is a diagram illustrating a tiled-display formed with the plurality of display apparatuses according to an embodiment of the present inventive concept.

FIG. 2 is a diagram illustrating a tiled-display formed with the plurality of display apparatuses according to an embodiment of the present inventive concept. The tiled display is a big display apparatus in which the plurality of display apparatus is integrated into one large nearly-seamless display in order to display ultra high resolution image.

Referring to FIGS. 1 and 2, the display apparatus may be one of the display apparatus that included in the tiled display according to an embodiment. In this case, the display panel 100 included in the display apparatus according to an embodiment may corresponds to one of a plurality of partial screens included in the tiled display. That is, the display panel 100 may be one of partial display panels 100*a* of the tiled display.

A bezel BZ may be disposed between the partial display panels of the tiled display. The user may perceive the whole screen of the tiled display as a single display apparatus.

Thus, the image quality of the tiled display may be enhanced by reducing a width of the bezel BZ.

Figure 3:
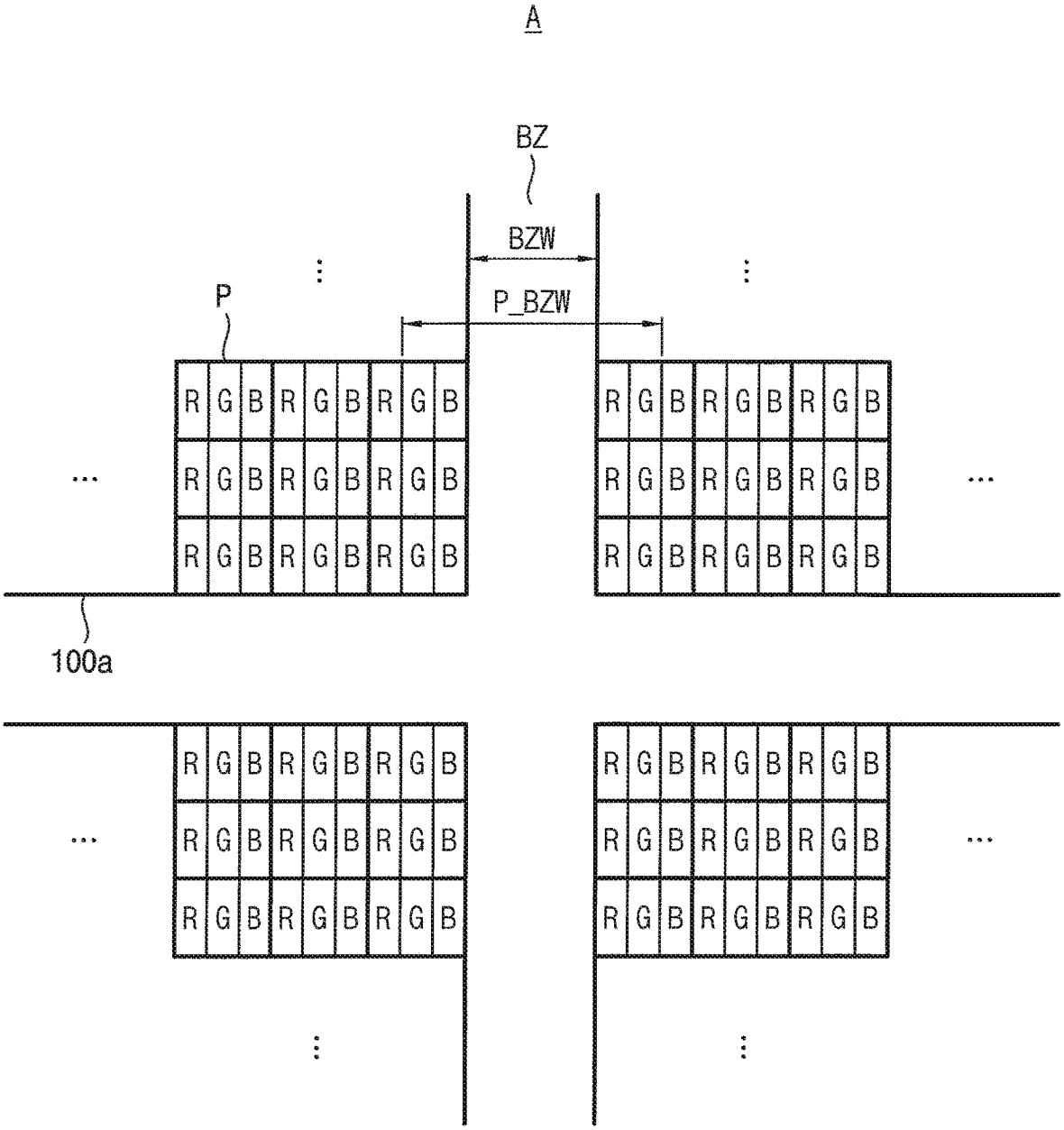
FIG. 3 is a diagram illustrating A part of FIG. 2.

FIG. 3 is a diagram illustrating A part of FIG. 2.

Referring to FIGS. 1 to 3, the partial display panel 100*a* may include a plurality of pixels. The pixel P may include a plurality of subpixels. For example, the pixel P may include a red subpixel R, a green subpixel G, and a blue subpixel B.

The other partial display panels included in the tiled display may be substantially the same as the partial display panel 100*a* of FIG. 3.

The bezel BZ may be a space between the partial display panels. The pixels are not disposed in the bezel BA. That is, the image may not be displayed through the bezel BZ.

A bezel width BZW is a shortest distance between subpixels disposed in adjacent partial display panel 100*a*. The bezel width BZW may not be changed after the tiled display is manufactured.

A perception bezel width P_BZW is a width that the user perceives as the bezel BZ. The perception bezel width P_BZW may increase as edge portions of the partial display panels of the tiled display become darker. In most cases, the perception bezel width P_BZW is wider than the bezel width BZW. The display quality of the tiled display may be enhanced by decreasing the perception bezel width P_BZW. The perception bezel width P_BZW may be changed according to a property of the image displayed on the partial display panels 100*a* after the tiled display is manufactured.

In other embodiments, the display apparatus according to an embodiment may be a single display, not the part of the tile display although not shown.

Figure 4:
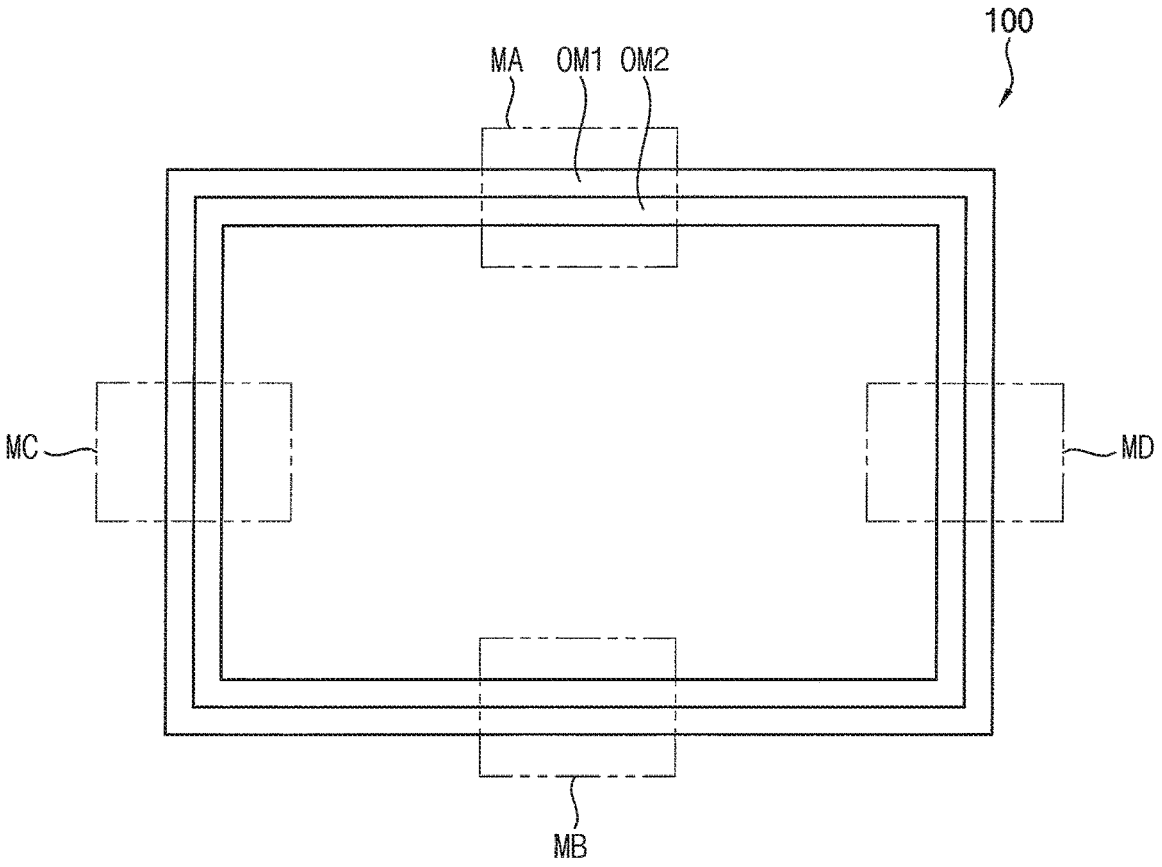
FIG. 4 is a conceptual diagram illustrating a display panel of FIG. 1.
Figure 5:
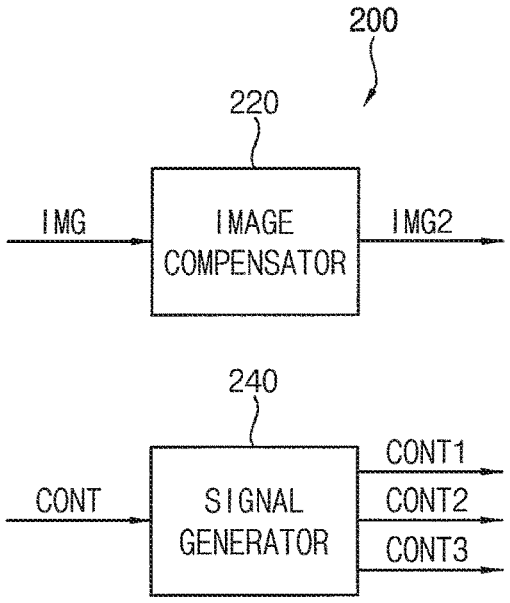
FIG. 5 is a block diagram illustrating a driving controller of FIG. 1.
Figure 6:
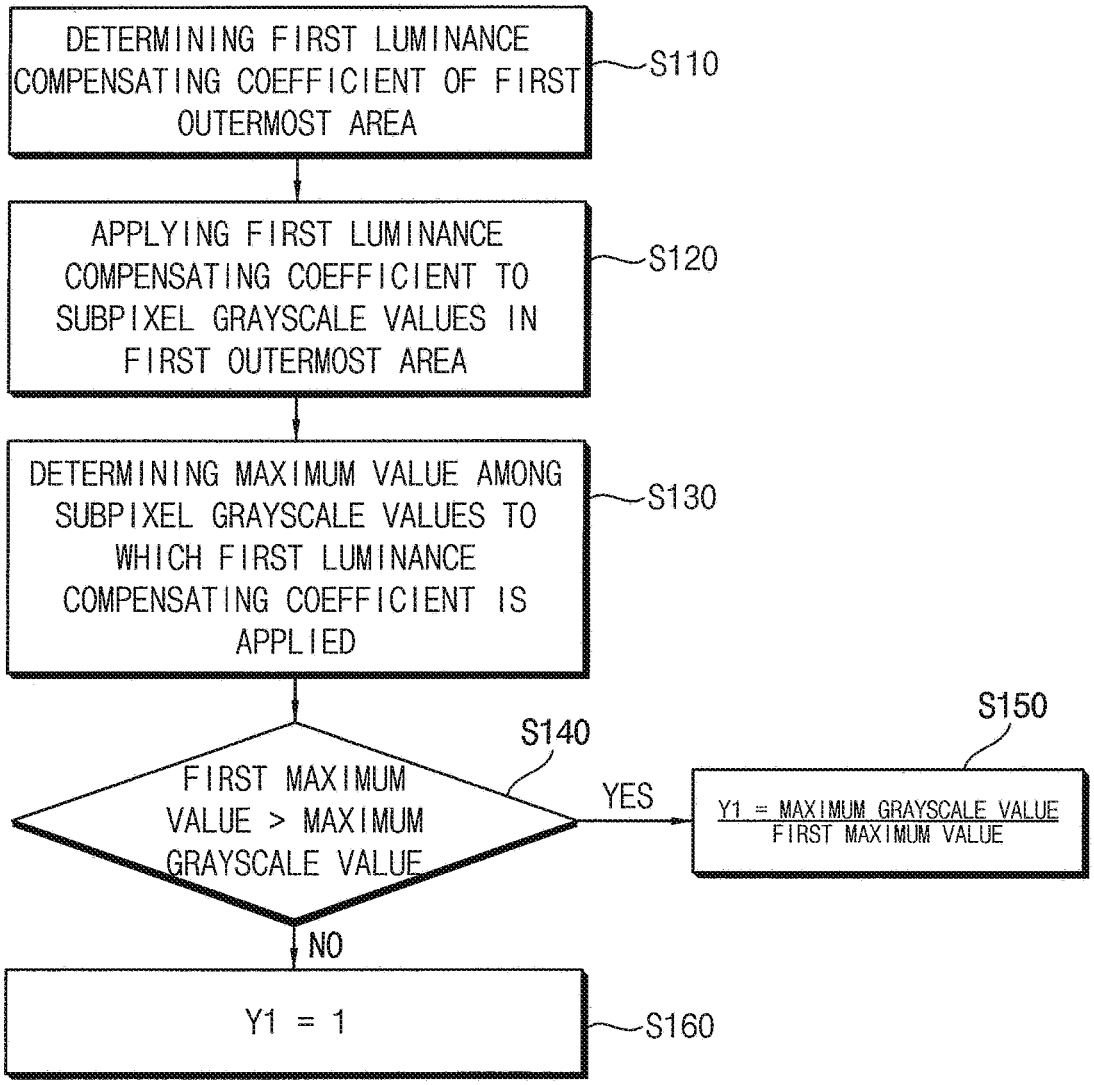
FIG. 6 is a flowchart illustrating a method of compensating a first outermost area of the display panel operated by an image compensator of FIG. 5.
Figure 7:
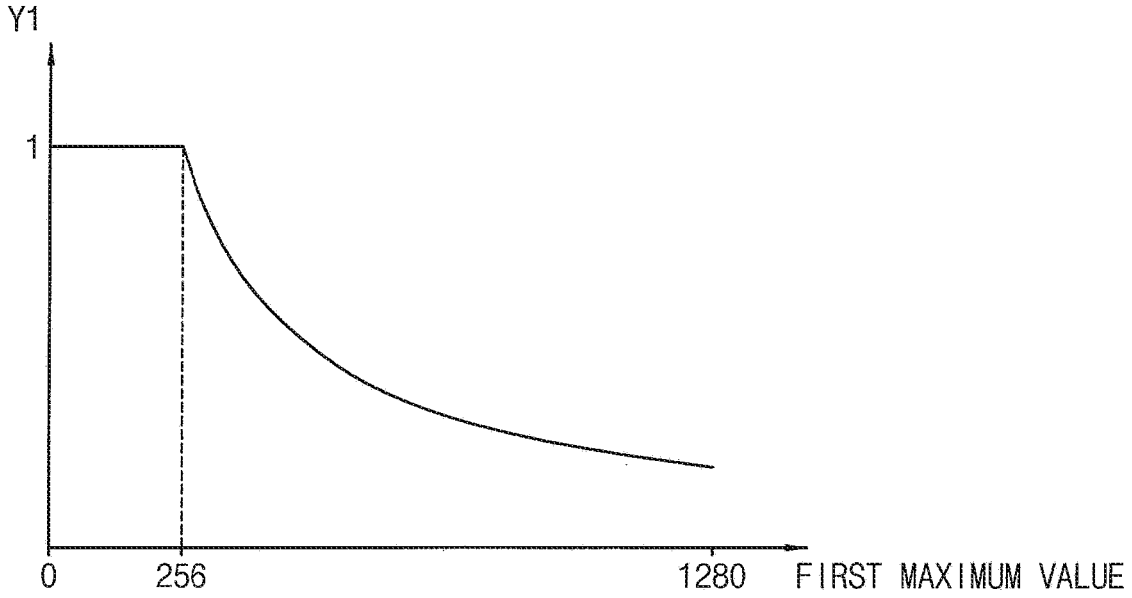
FIG. 7 is a graph illustrating a compensation ratio used by the image compensator of FIG. 5.
Figure 8A:
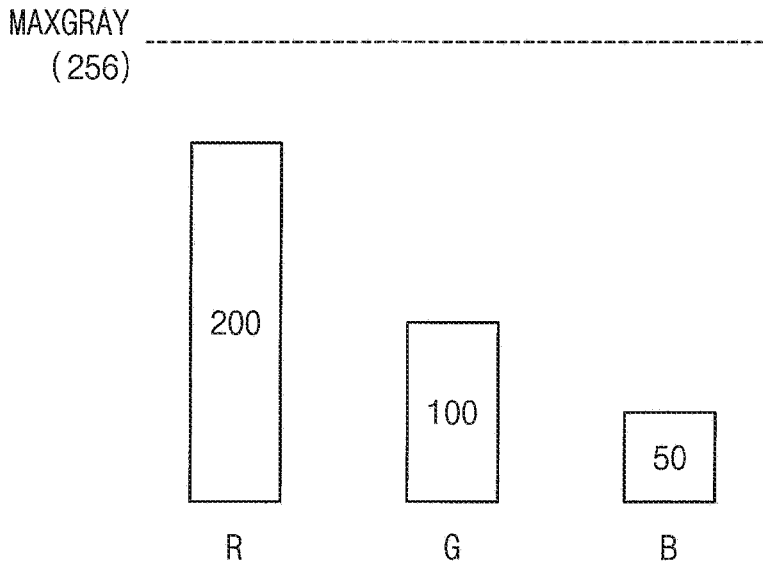
FIG. 8A is a conceptual diagram illustrating input image data.
Figure 8B:
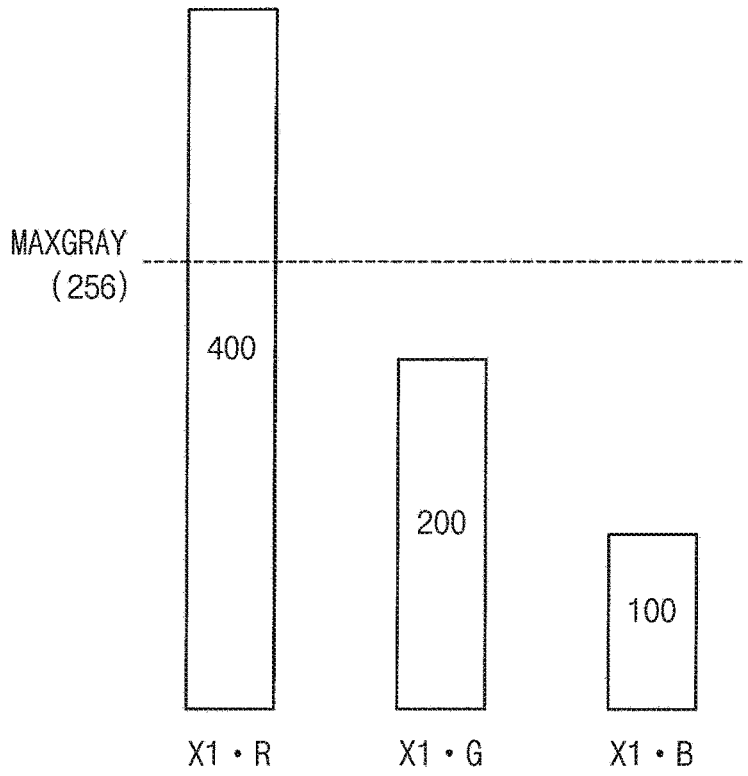
FIG. 8B is a conceptual diagram illustrating the input image data which is compensated using a luminance compensating coefficient.
Figure 8C:
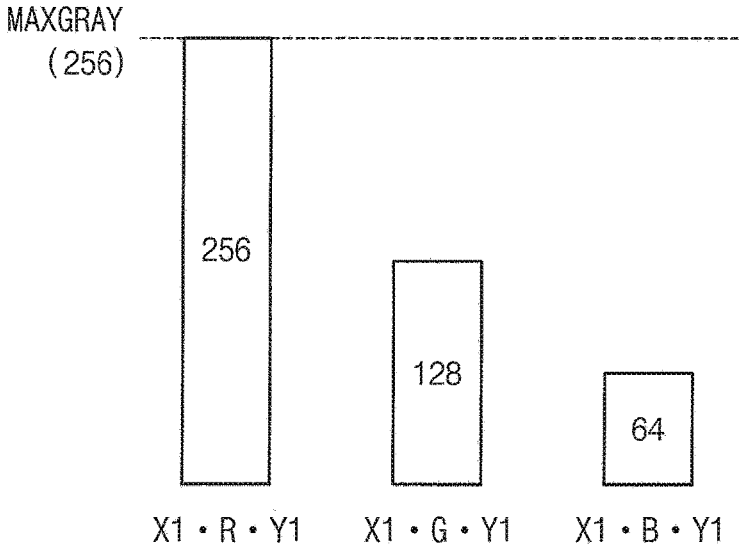
FIG. 8C is a conceptual diagram illustrating input image data which is compensated using the luminance compensating coefficient and the compensation ratio.

FIG. 4 is a conceptual diagram illustrating the display panel 100 of FIG. 1. FIG. 5 is a block diagram illustrating the driving controller 200 of FIG. 1. FIG. 6 is a flowchart illustrating a method of compensating a first outermost area OM1 of the display panel 100 operated by an image compensator 220 of FIG. 5. FIG. 7 is a graph illustrating a compensation ratio used by the image compensator 220 of FIG. 5. FIG. 8A is a conceptual diagram illustrating input image data IMG. FIG. 8B is a conceptual diagram illustrating the input image data which is compensated using a luminance compensating coefficient. FIG. 8C is a conceptual diagram illustrating input image data IMG2 which is compensated using the luminance compensating coefficient and the compensation ratio.

Referring to FIGS. 1 to 8C, the driving controller 200 may generate compensated image data IMG2 which is compensated for decrease in luminance of the edge portion of the display panel 100 based on the input image data IMG to decrease the perception bezel width P_BZW of the display panel 100.

The display panel 100 may include the first outermost area OM1 and a second outermost area OM2 adjacent to the first outermost area OM1 and closer to a center of the display panel 100 than the first outermost area OM1.

The luminance of the first outermost area OM1 and the luminance of the second outermost area OM2 of the display panel 100 perceived by the user may be decreased. A decrease in luminance of the first outermost area OM1 may be greater than a decrease in luminance of the second outermost area OM2.

The first outermost area OM1 may have a first predetermined width from an outermost edge line of the display panel 100. For example, the first outermost area OM1 may include a number of pixel rows or a number of pixel columns from the outermost edge line of the display panel 100. The width of the first outermost area OM1 may be determined according to characteristics of the display panel 100 and may be set by a manufacturer or the user.

The second outermost area OM2 may have a second predetermined width from inner boundaries of the first outermost area OM1 of the display panel 100. For example, the second outermost area OM2 may include a number of pixel rows or a number of pixel columns from the inner boundaries of the first outermost area OM1 of the display panel 100. The width of the second outermost area OM2 may be determined according to the characteristics of the display panel 100 and may be set by a manufacturer or the user.

The compensation of the input image data IMG may be performed on a plurality of edge areas MA, MB, MC and MD. For example, the compensation of the input image data IMG may be performed on a first edge area MA, a second edge area MB, a third edge area MC and a fourth edge area MD. The driving controller 200 may compensate the first outermost area OM1 and the second outermost area OM2 using an average of the compensation values of the edge areas MA, MB, MC and MD. Alternatively, the driving controller 200 may compensate the first outermost area OM1 and the second outermost area OM2 using a worst case (a maximum compensation value) of the compensation values of the edge areas MA, MB, MC and MD. Alternatively, the driving controller 200 may compensate respective edge areas MA, MB, MC and MD using the respective compensation values of the edge areas MA, MB, MC and MD.

The driving controller 200 may include the image compensator 220 and a signal generator 240.

The image compensator 220 generates the compensated image data IMG2 which is compensated for the decrease of the luminance of the edge area of the display panel 100 based on the input image data IMG. The image compensator 220 may compare the maximum grayscale values of the input image data IMG to which the luminance compensating coefficient is applied and the maximum grayscale value of the input image data IMG to generate the compensated image data IMG2. The luminance compensating coefficient may be determined according to a location of the subpixel in the display panel 100.

The image compensator 220 may simultaneously or selectively perform a luminance compensation of the edge portion of the display panel 100, the adaptive color correction ("ACC"), the dynamic capacitance compensation ("DCC") and so on. In the present embodiment, the operation of the luminance compensation of the edge portion of the display panel 100 is mainly explained hereinafter.

The signal generator 240 receives the input control signal CONT. The signal generator 240 generates the first control signal CONT1 for controlling a driving timing of the gate driver 300 and the second control signal CONT2 for controlling a driving timing of the data driver 500 based on the input control signal CONT. The signal generator 240 generates the third control signal CONT3 for controlling a driving timing of the gamma reference voltage generator 400 based on the input control signal CONT The signal generator 240 outputs the first control signal CONT1 to the gate driver 300. The signal generator 240 outputs the second control signal CONT2 to the data driver 500. The signal generator 240 outputs the third control signal CONT3 to the gamma reference voltage generator 400.

The image compensator 220 may determine a first luminance compensating coefficient X1 of the first outermost area OM1 of the display panel 100 (step S110). The first luminance compensating coefficient X1 may mean a compensation gain for compensation of the decrease of the perceived luminance of the first outermost area OM1.

The first luminance compensating coefficient X1 may be determined in consideration of the perceived luminance of the first outer most area OM1. For example, when the perceived luminance of the first outer most area OM1 decreases to a half of a target luminance, the first luminance compensating coefficient X1 may be about 2 to compensate the decrease of the perceived luminance of the first outermost area OM1. In the present embodiment, the first luminance compensating coefficient X1 may not be based on an actual luminance but based on a grayscale value. Thus, when the perceived luminance of the first outer most area OM1 decreases to a half of a target luminance, the first luminance compensating coefficient X1 may be a grayscale compensation gain to double the luminance of the first outer most area OM1.

The image compensator 220 may apply the first compensation coefficient X1 to the subpixel grayscale values (e.g. R, G and B) of the first outermost area OM1 (step S120). The subpixel grayscale values of the first outermost area OM1 to which the first compensation coefficient X1 is applied may be represented as X1·R, X1·G, X1·B.

The image compensator 220 may determine a first maximum value (MAX(X1·R, X1·G, X1·B)) which is a maximum value among the subpixel grayscale values X1·R, X1·G, X1·B of the first outermost area OM1 to which the first compensation coefficient X1 is applied (step S130).

The image compensator 220 may compare the first maximum value and a maximum grayscale value of the input image data IMG (step S140). When the input image data IMG is 8 bits, the input image data IMG may have grayscale values between 1 to 256. The maximum grayscale value of the input image data IMG may be 256. Generally, the grayscale values of 8 bits are represented from 0 to 255. In the present embodiment, the grayscale values of 8 bits are represented from 1 to 256 for convenience of explanation. For example, when the input image data IMG is 10 bits, the input image data IMG may have grayscale values between 1 to 1024 and the maximum grayscale value of the input image data IMG may be 1024. In the present embodiment, for example, the input image data may be 8 bits for convenience of explanation.

For example, when the first maximum value (MAX(X1·R, X1·G, X1·B)) is greater than the maximum grayscale value (e.g. 256), the image compensator 220 may determine a first compensation ratio Y1 as (the maximum grayscale value)/(the first maximum value) (step S150). When the first maximum value (MAX(X1·R, X1·G, X1·B)) is greater than the maximum grayscale value (e.g. 256), at least one of a multiplication (e.g. X1·R) of the first subpixel grayscale value (e.g. R) and the first luminance compensating coefficient X1, a multiplication (e.g. X1·G) of the second subpixel grayscale value (e.g. G) and the first luminance compensating coefficient X1 and a multiplication (e.g. X1·B) of the third subpixel grayscale value (e.g. B) and the first luminance compensating coefficient X1 may exceed the maximum grayscale value (e.g. 256). In addition, when at least one of the first maximum value (MAX(X1·R, X1·G, X1·B)) is greater than the maximum grayscale value (e.g. 256), it means that at least one of the grayscale value of the first maximum value (X1·R, X1·G, X1·B) exceeds a displayable maximum grayscale (e.g. 256). In this case, the first compensation ratio Y1 which is less than 1 may be multiplied to all of the first maximum value (X1·R, X1·G, X1·B) so that the all of the first maximum value (X1·R, X1·G, X1·B) may be decreased to be equal to or less than the displayable maximum grayscale (e.g. 256).

The first compensation ratio Y1 according to the first maximum value (MAX(X1·R, X1·G, X1·B)) may be represented as the graph of FIG. 7. The graph of FIG. 7 may be stored in the driving controller 200 in a lookup table. Thus, the driving controller 200 may generate the compensated image data IMG2 by a simple operation of the first maximum value (MAX(X1·R, X1·G, X1·B)).

For example, when the first maximum value (MAX(X1·R, X1·G, X1·B)) is equal to or less than the maximum grayscale value (e.g. 256), the image compensator 220 may determine the first compensation ratio Y1 as 1 (step S160). When the first maximum value (MAX(X1·R, X1·G, X1·B)) is equal to or less than the maximum grayscale value (e.g. 256), the multiplication (e.g. X1·R) of the first subpixel grayscale value (e.g. R) and the first luminance compensating coefficient X1, the multiplication (e.g. X1·G) of the second subpixel grayscale value (e.g. G) and the first luminance compensating coefficient X1 and the multiplication (e.g. X1·B) of the third subpixel grayscale value (e.g. B) and the first luminance compensating coefficient X1 may not exceed the maximum grayscale value (e.g. 256). Thus, in this case, the first compensation ratio Y1 is set to 1 so that the compensated image data IMG2 may be generated using the multiplication (e.g. X1·R) of the first subpixel grayscale value (e.g. R) and the first luminance compensating coefficient X1, the multiplication (e.g. X1·G) of the second subpixel grayscale value (e.g. G) and the first luminance compensating coefficient X1 and the multiplication (e.g. X1·B) of the third subpixel grayscale value (e.g. B) and the first luminance compensating coefficient X1.

The image compensator 220 may generate the compensated image data IMG2 by multiplying the first luminance compensating coefficient X1 and the first compensation ratio Y1 to the subpixel grayscale values (R, G, B) of the first outermost area OM1. The same compensation ratio Y1 is applied to the subpixel grayscale values (R, G, B) having different colors in a same pixel so that the color of the input image data IMG may not be altered when compensating the luminance of the input image data IMG.

In FIG. 8A, when a pixel includes a first subpixel, a second subpixel and a third subpixel, the first subpixel grayscale value R in the image data IMG of the pixel of the first outermost area OM1 may be 200, the second subpixel grayscale value G in the image data IMG of the pixel of the first outermost area OM1 may be 100 and the third subpixel grayscale value B in the image data IMG of the pixel of the first outermost area OM1 may be 50. In case, the perceived gray scale value of the pixel of the first outermost area OM1 is decreases to a half of a target luminance, the first luminance compensating coefficient X1 may be two.

In FIG. 8B, the first subpixel grayscale value X1·R to which the first luminance compensating coefficient X1 is applied may be 400, the second subpixel grayscale value X1·G to which the first luminance compensating coefficient X1 is applied may be 200 and the third subpixel grayscale value X1·B to which the first luminance compensating coefficient X1 is applied may be 100.

Herein, the first maximum value (MAX(X1·R, X1·G, X1·B)) which is a maximum value among the subpixel grayscale values X1·R, X1·G, X1·B of the first outermost area OM1 to which the first compensation coefficient X1 is applied may be 400 (X1·R).

The first maximum value X1·R (400) is greater than the maximum grayscale value (256) so that the first compensation ratio Y1 may be determined as 256/400.

In FIG. 8C, the first compensation ratio Y1 (256/400) is respectively multiplied to the first subpixel grayscale value X1·R (400) to which the first luminance compensating coefficient X1 is applied, the second subpixel grayscale value X1·G (200) to which the first luminance compensating coefficient X1 is applied and the third subpixel grayscale value X1·B (100) to which the first luminance compensating coefficient X1 is applied so that the first subpixel grayscale value of the compensated image data IMG2, the second subpixel grayscale value of the compensated image data IMG2 and the third subpixel grayscale value of the compensated image data IMG2 may be respectively 256, 128 and 64.

In another example, when the first subpixel grayscale value R in the image data IMG of the pixel of the first outermost area OM1 may be 100, the second subpixel grayscale value G in the image data IMG of the pixel of the first outermost area OM1 may be 50, the third subpixel grayscale value B in the image data IMG of the pixel of the first outermost area OM1 may be 25 and the first luminance compensating coefficient X1 may be two, the first subpixel grayscale value X1·R to which the first luminance compensating coefficient X1 is applied may be 200, the second subpixel grayscale value X1·G to which the first luminance compensating coefficient X1 is applied may be 100 and the third subpixel grayscale value X1·B to which the first luminance compensating coefficient X1 is applied may be 50.

Herein, the first maximum value (MAX(X1·R, X1·G, X1·B)) which is a maximum value among the subpixel grayscale values X1·R, X1·G, X1·B of the first outermost area OM1 to which the first compensation coefficient X1 is applied may be 200 (X1·R).

The first maximum value X1·R (200) is equal to or less than the maximum grayscale value (256) so that the first compensation ratio Y1 may be determined as 1.

When the first compensation ratio Y1 (1) is respectively multiplied to the first subpixel grayscale value X1·R to which the first luminance compensating coefficient X1 is applied, the second subpixel grayscale value X1·G to which the first luminance compensating coefficient X1 is applied and the third subpixel grayscale value X1·B to which the first luminance compensating coefficient X1 is applied, the first subpixel grayscale value of the compensated image data IMG2, the second subpixel grayscale value of the compensated image data IMG2 and the third subpixel grayscale value of the compensated image data IMG2 may be respectively 200, 100 and 50.

Figure 9:
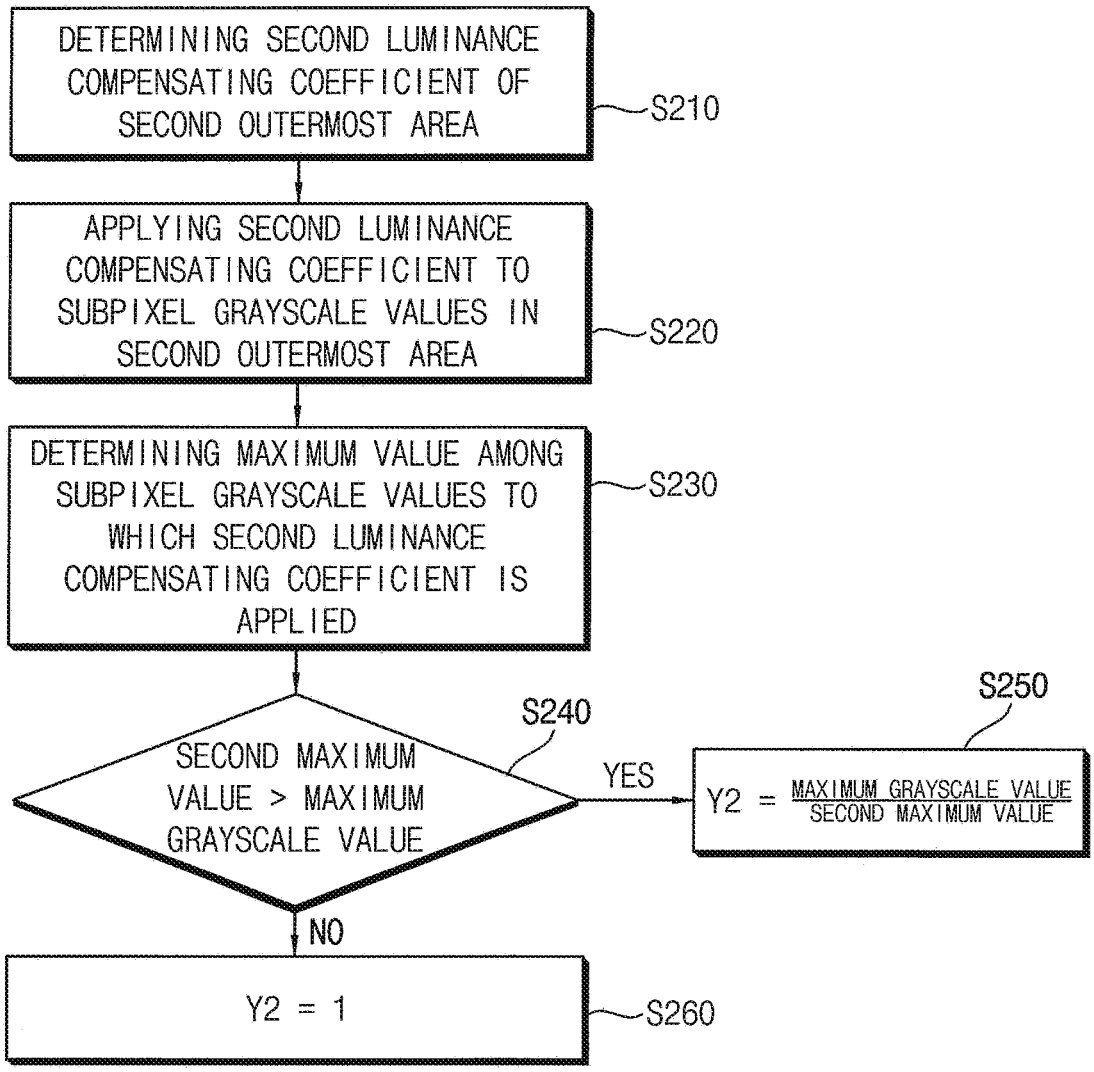
FIG. 9 is a flowchart illustrating a method of compensating a second outermost area of the display panel operated by the image compensator of FIG. 5.

FIG. 9 is a flowchart illustrating a method of compensating a second outermost area OM2 of the display panel 100 operated by the image compensator 220 of FIG. 5.

In the present embodiment, the luminance decreases of the second outermost area OM2 may be compensated using subpixel grayscale values of a pixel in the second outermost area OM2 in the same way as compensation of the luminance decrease of the first outermost area OM1.

The image compensator 220 may determine a second luminance compensating coefficient X2 of the second outermost area OM2 of the display panel 100 (step S210). The second luminance compensating coefficient X2 may mean a compensation gain for compensation of the decrease of the luminance of the second outermost area OM2. The second luminance compensating coefficient X2 for compensation of the decrease of the luminance of the second outermost area OM2 may be less than the first luminance compensating coefficient X1 for compensation of the decrease of the luminance of the first outermost area OM1.

For example, when the luminance of the second outer most area OM2 decreases to three quarter of a target luminance, the second luminance compensating coefficient X2 may be a grayscale compensation gain (1.333) to increase the luminance of the second outer most area OM2 by about 33.3%.

The image compensator 220 may apply the second compensation coefficient X2 to the subpixel grayscale values (e.g. R, G and B) of the second outermost area OM2 (step S220). The subpixel grayscale values of the second outermost area OM2 to which the second compensation coefficient X2 is applied may be represented as X2·R, X2·G, X2·B.

The image compensator 220 may determine a second maximum value (MAX(X2·R, X2·G, X2·B)) which is a maximum value among the subpixel grayscale values X2·R, X2·G, X2·B of the second outermost area OM2 to which the second compensation coefficient X2 is applied (step S230).

The image compensator 220 may compare the second maximum value and the maximum grayscale value of the input image data IMG (step S240).

For example, when the second maximum value (MAX (X2·R, X2·G, X2·B)) is greater than the maximum grayscale value (e.g. 256), the image compensator 220 may determine a second compensation ratio Y2 as (the maximum grayscale value)/(the second maximum value) (step S250).

For example, when the second maximum value (MAX (X2·R, X2·G, X2·B)) is equal to or less than the maximum grayscale value (e.g. 256), the image compensator 220 may determine the second compensation ratio Y2 as 1 (step S260).

The image compensator 220 may generate the compensated image data IMG2 by multiplying the second luminance compensating coefficient X2 and the second compensation ratio Y2 to the subpixel grayscale values (R, G, B) of the second outermost area OM2. The same compensation ratio Y2 is multiplied to the subpixel grayscale values (R, G, B) having different colors in the same pixel so that the color of the input image data IMG may not be altered when compensating the luminance of the input image data IMG.

According to the present embodiment, the image data of the edge portion of the display panel 100 are compensated based on an actual perceived decrease ratio of luminance of the edge portion of the display panel 100 so that the perceived decrease of the luminance of the edge portion of the display panel 100 may be compensated.

In addition, when the perceived decrease of the luminance of the edge portion of the display panel 100 is compensated, the compensation ratio Y1 and Y2 is determined using the maximum value of the grayscale values of the subpixels so that a color may not be altered.

The bezel width perceived by a user may decrease and the color may not be altered when compensating the luminance so that the display quality of the display panel 100 may be enhanced.

Figure 10:
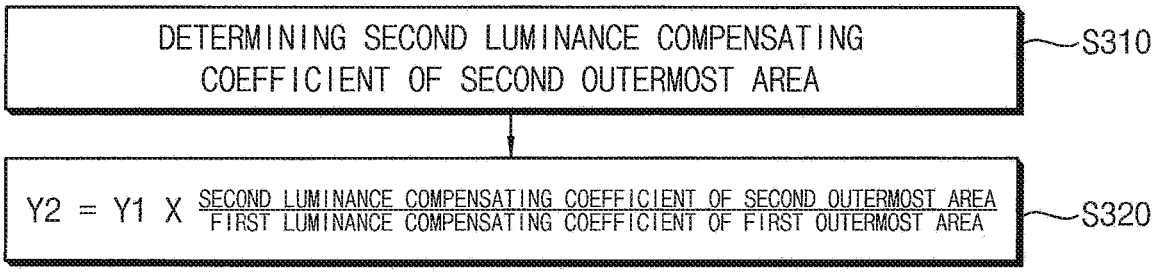
FIG. 10 is a flowchart illustrating a method of compensating a second outermost area of a display panel operated by an image compensator of a display apparatus according to an embodiment of the present inventive concept.

FIG. 10 is a flowchart illustrating a method of compensating a second outermost area OM2 of a display panel 100 operated by an image compensator 220 of a display apparatus according to an embodiment of the present inventive concept.

The display apparatus and the method of driving the display panel according to the present embodiment is substantially the same as the display apparatus and the method of driving the display panel of the previous embodiment explained referring to FIGS. 1 to 9 except for the method of compensating the input image data of the second outermost area. Thus, the same reference numerals will be used to refer to the same or like parts as those described in the previous embodiment of FIGS. 1 to 9 and any repetitive explanation concerning the above elements will be omitted.

Referring to FIGS. 1 to 8 and 10, the image compensator 220 may determine a second luminance compensating coefficient X2 of the second outermost area OM2 of the display panel 100 (step S310). The second luminance compensating coefficient X2 may mean a compensation gain for compensation of the decrease of the luminance of the second outermost area OM2. The second luminance compensating coefficient X2 for compensation of the decrease of the luminance of the second outermost area OM2 may be less than the first luminance compensating coefficient X1 for compensation of the decrease of the luminance of the first outermost area OM1.

The image compensator 220 may determine the second compensation ratio Y2 by multiplying ((the second luminance compensating coefficient X2)/(the first luminance compensating coefficient X1)) to the first compensation ratio Y1 (step S320). When the first luminance compensating coefficient X1 is two and the second luminance compensating coefficient X2 is 1.333, the second compensation ratio Y2 may be determined by multiplying 0.667 to the first compensation ratio Y1.

In the present embodiment, the second compensation ratio Y2 is determined not based on the subpixel grayscale values of the second outermost area OM2 but based on the ratio between the first luminance compensating coefficient X1 and the second luminance compensating coefficient X2 so that the second compensation ratio Y2 may be determined more simply.

According to the present embodiment, the image data of the edge portion of the display panel 100 are compensated based on an actual perceived decrease ratio of luminance of the edge portion of the display panel 100 so that the perceived decrease of the luminance of the edge portion of the display panel 100 may be compensated.

In addition, when the perceived decrease of the luminance of the edge portion of the display panel 100 is compensated, the compensation ratio Y1 and Y2 is determined using the maximum value of the grayscale values of the subpixels so that a color may not be altered.

The bezel width perceived by a user may decrease and the color may not be altered when compensating the luminance so that the display quality of the display panel 100 may be enhanced.

Figure 11:
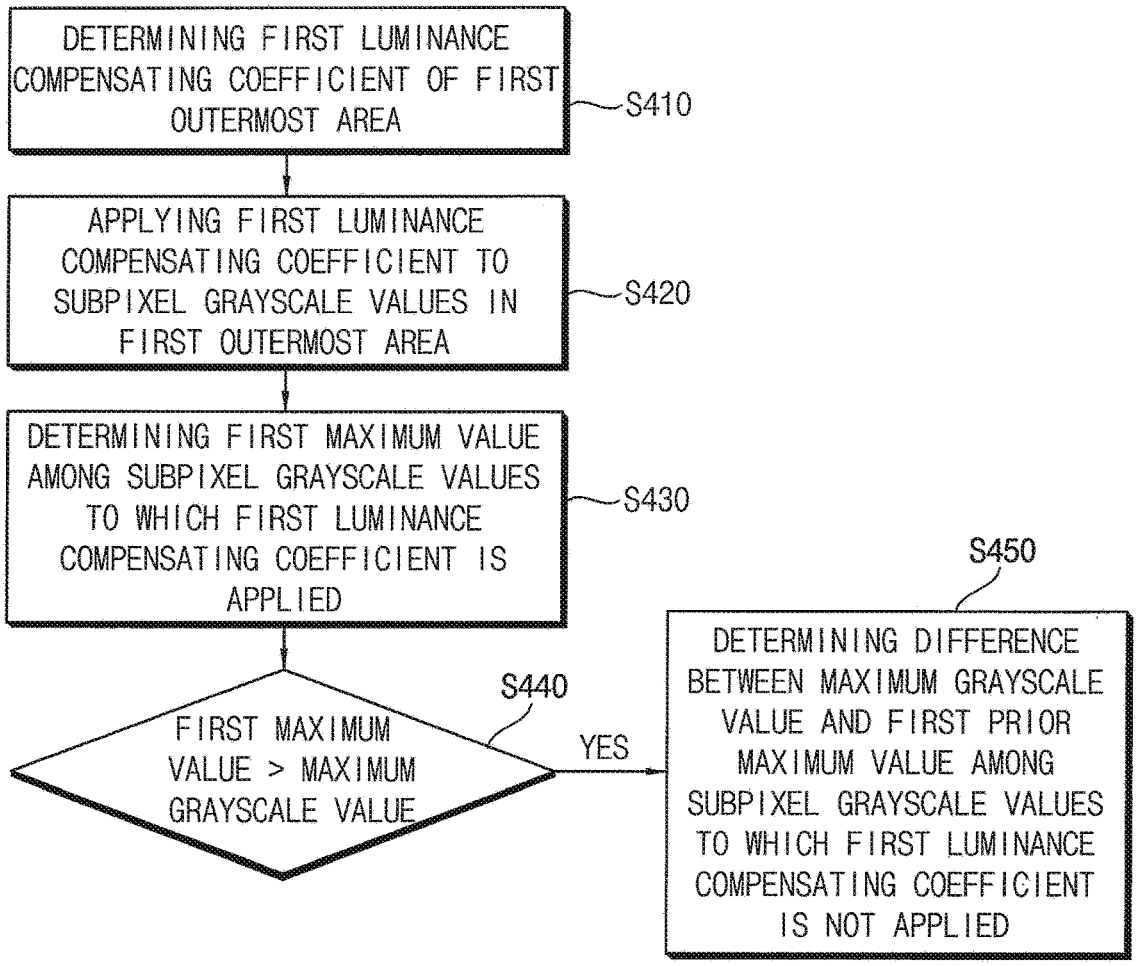
FIG. 11 is a flowchart illustrating a method of compensating a first outermost area of a display panel operated by an image compensator of a display apparatus according to an embodiment of the present inventive concept.
Figure 12A:
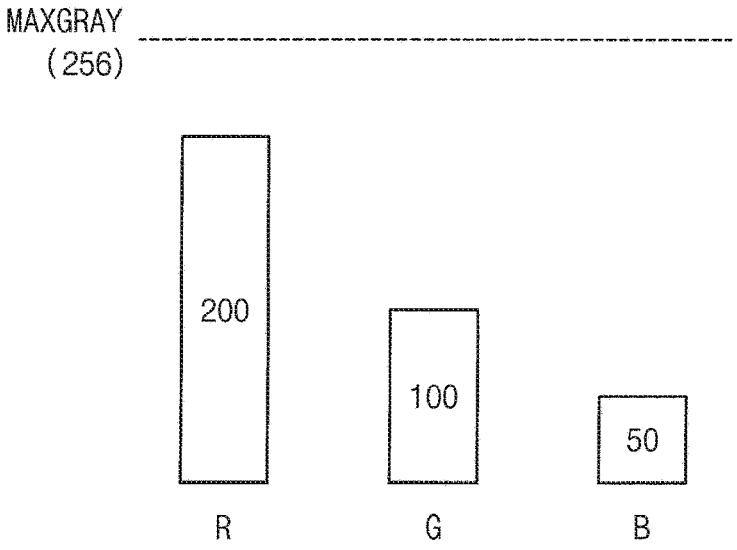
FIG. 12A is a conceptual diagram illustrating input image data.
Figure 12B:
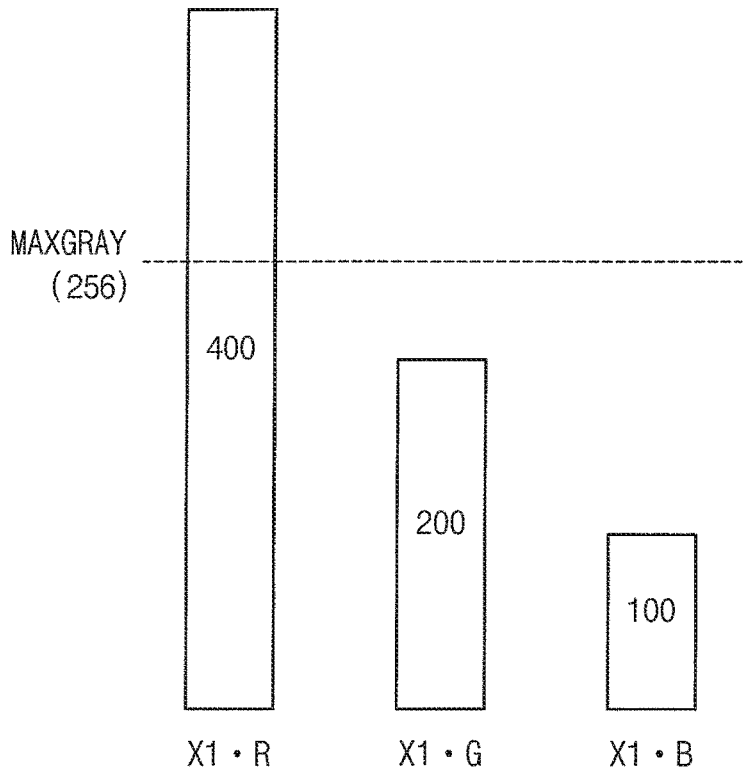
FIG. 12B is a conceptual diagram illustrating the input image data to which a luminance compensating coefficient is applied.
Figure 12C:
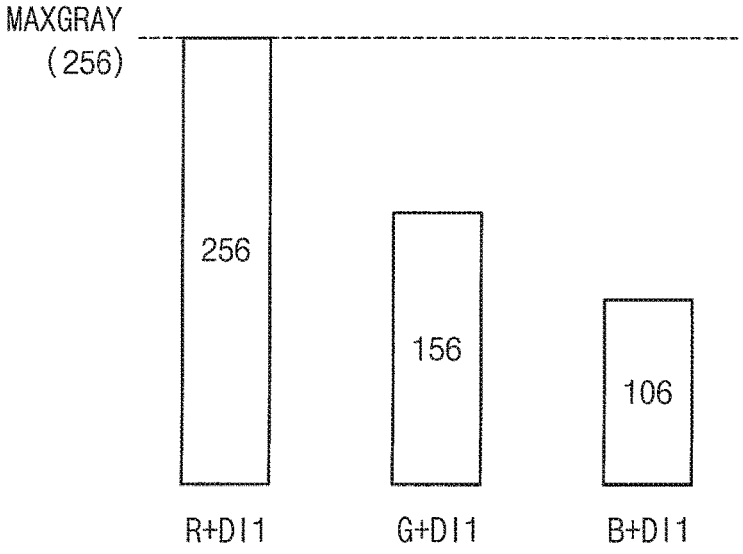
FIG. 12C is a conceptual diagram illustrating input image data to which a compensation grayscale difference is applied.
Figure 13:
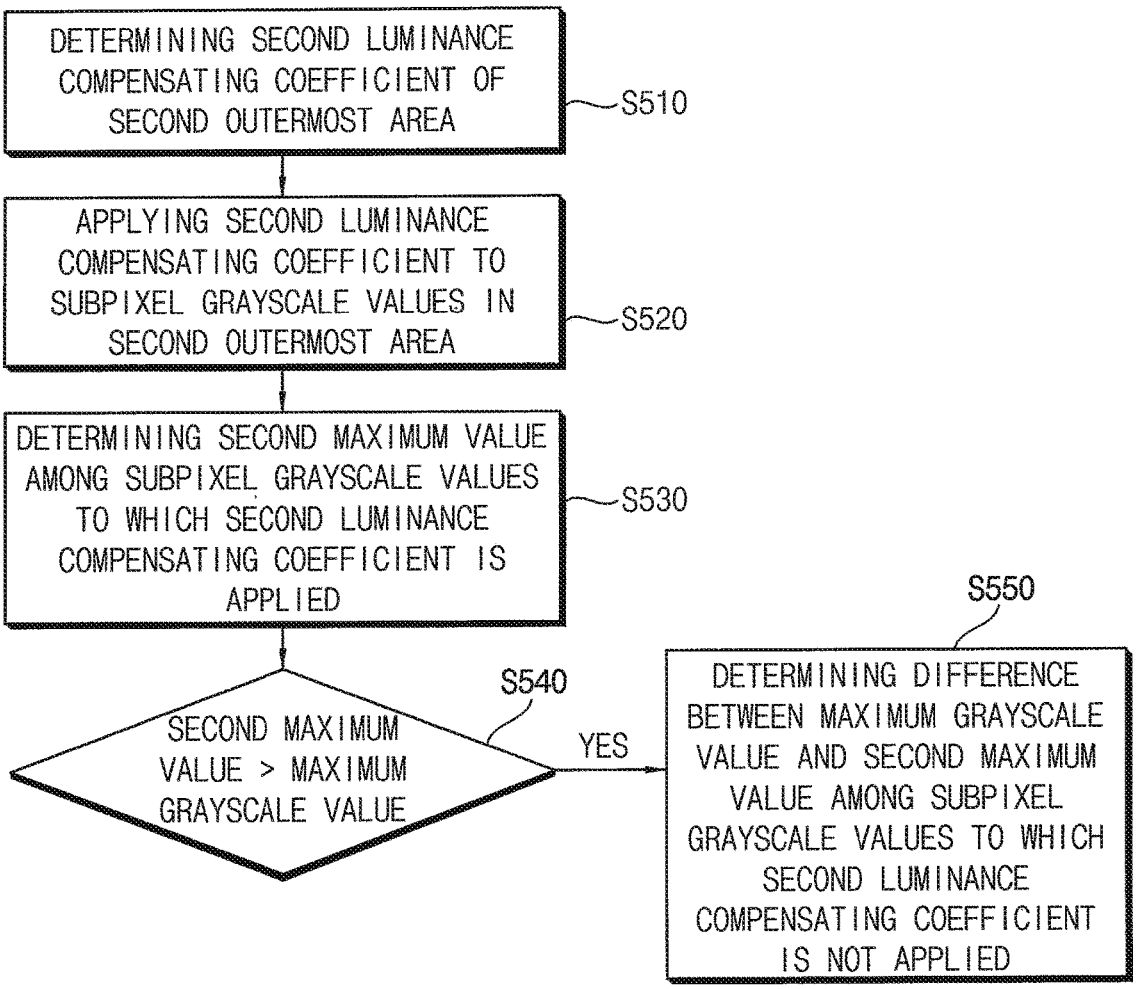
FIG. 13 is a flowchart illustrating a method of compensating a second outermost area of the display panel operated by the image compensator of FIG. 11.

FIG. 11 is a flowchart illustrating a method of compensating a first outermost area OM1 of a display panel 100 performed by an image compensator 220 of a display apparatus according to an embodiment of the present inventive concept. FIG. 12A is a conceptual diagram illustrating input image data IMG. FIG. 12B is a conceptual diagram illustrating the input image data to which a luminance compensating coefficient is applied. FIG. 12C is a conceptual diagram illustrating input image data IMG2 to which a compensation grayscale difference is applied. FIG. 13 is a flowchart illustrating a method of compensating a second outermost area OM2 of the display panel 100 operated by the image compensator 220 of FIG. 11.

The display apparatus and the method of driving the display panel according to the present embodiment is substantially the same as the display apparatus and the method of driving the display panel of the previous embodiment explained referring to FIGS. 1 to 9 except for the method of compensating the input image data of the first outermost area. Thus, the same reference numerals will be used to refer to the same or like parts as those described in the previous embodiment of FIGS. 1 to 9 and any repetitive explanation concerning the above elements will be omitted.

Referring to FIGS. 1 to 5 and 11 to 13, the driving controller 200 may generate compensated image data IMG2 which is compensated for decrease in luminance of the edge portion of the display panel 100 based on the input image data IMG to decrease the perception bezel width P_BZW of the display panel 100.

The display panel 100 may include the first outermost area OM1 and a second outermost area OM2 adjacent to the first outermost area OM1 and closer to a center of the display panel 100 than the first outermost area OM1.

The driving controller 200 may include the image compensator 220 and a signal generator 240.

The image compensator 220 generates the compensated image data IMG2 which is compensated for the decrease in the luminance of the edge area of the display panel 100 based on the input image data IMG. The image compensator 220 may compare the maximum value of the subpixel grayscale values of the input image data IMG to which the luminance compensating coefficient is applied and the maximum grayscale value of the input image data IMG to generate the compensated image data IMG2. The luminance compensating coefficient may be determined according to a location in the display panel 100.

The image compensator 220 may determine a first luminance compensating coefficient X1 of the first outermost area OM1 of the display panel 100 (step S410).

The image compensator 220 may apply the first compensation coefficient X1 to the subpixel grayscale values (e.g. R, G and B) of the first outermost area OM1 (step S420). The subpixel grayscale values of the first outermost area OM1 to which the first compensation coefficient X1 is applied may be represented as X1·R, X1·G, X1·B.

The image compensator 220 may determine a first maximum value (MAX(X1·R, X1·G, X1·B)) which is a maximum value among the subpixel grayscale values X1·R, X1·G, X1·B of the first outermost area OM1 to which the first compensation coefficient X1 is applied (step S430).

The image compensator 220 may compare the first maximum value and a maximum grayscale value of the input image data IMG (step S440).

For example, when the first maximum value (MAX(X1·R, X1·G, X1·B)) is greater than the maximum grayscale value (e.g. 256), the image compensator 220 may determine a first compensation grayscale difference DI1 as a difference between the maximum grayscale value (e.g. 256) and a first prior maximum value MAX(R, G, B) which is a maximum value among the subpixel grayscale values of the first outermost area OM1 to which the first luminance compensating coefficient is not applied (step S450).

When the first maximum value (MAX(X1·R, X1·G, X1·B)) is greater than the maximum grayscale value (e.g. 256), the image compensator 220 may generate the compensated image data IMG2 by adding the first compensation grayscale difference DI1 to the subpixel grayscale values (R, G, B) of the first outermost area OM1. The same compensation grayscale difference DI1 is added to the subpixel grayscale values (R, G, B) having different colors in a pixel so that the color of the input image data IMG may not be largely altered when compensating the luminance of the input image data IMG.

In FIG. 12A, when a pixel includes a first subpixel, a second subpixel and a third subpixel, the first subpixel grayscale value R in the image data IMG of the pixel of the first outermost area OM1 may be 200, the second subpixel grayscale value G in the image data IMG of the pixel of the first outermost area OM1 may be 100 and the third subpixel grayscale value B in the image data IMG of the pixel of the first outermost area OM1 may be 50. In case, the perceived gray scale value of the pixel of the first outermost area OM1 is decreases to a half of a target luminance, the first luminance compensating coefficient X1 may be two.

In FIG. 12B, the first subpixel grayscale value X1·R to which the first luminance compensating coefficient X1 is applied may be 400, the second subpixel grayscale value X1·G to which the first luminance compensating coefficient X1 is applied may be 200 and the third subpixel grayscale value X1·B to which the first luminance compensating coefficient X1 is applied may be 100.

Herein, the first maximum value (MAX(X1·R, X1·G, X1·B)) which is a maximum value among the subpixel grayscale values X1·R, X1·G, X1·B of the first outermost area OM1 to which the first compensation coefficient X1 is applied may be 400 (X1·R).

The first maximum value 400 (X1·R) is greater than the maximum grayscale value (256) so that the first compensation grayscale difference DI1 may be determined as 256–200=56.

In FIG. 12C, the first compensation grayscale difference DI1 (56) is respectively added to the first subpixel grayscale value R (200), the second subpixel grayscale value G (100) and the third subpixel grayscale value B (50) so that the first subpixel grayscale value of the compensated image data IMG2, the second subpixel grayscale value of the compensated image data IMG2 and the third subpixel grayscale value of the compensated image data IMG2 may be respectively 256, 156 and 106.

When the first maximum value (MAX(X1·R, X1·G, X1·B)) is equal to or less than the maximum grayscale value (e.g. 256), the image compensator 220 may generate the compensated image data IMG2 using the subpixel grayscale values (X1·R, X1·G, X1·B) of the first outermost area OM1 to which the first luminance compensating coefficient X1 is applied.

In the present embodiment, as shown in FIG. 13, a second compensation grayscale difference DI2 may be determined using subpixel grayscale values of the second outermost area OM2 in the same way as the first compensation grayscale difference DI1 (steps S510, S520, S530, S540 and S550).

According to the present embodiment, the image data of the edge portion of the display panel 100 are compensated based on an actual decrease ratio of perceived luminance of the edge portion of the display panel 100 so that the decrease of the perceived luminance of the edge portion of the display panel 100 may be compensated.

In addition, when the decrease of the perceived luminance of the edge portion of the display panel 100 is compensated, the compensation grayscale difference DI1 and DI2 is determined using the maximum value of the grayscale values of the subpixels so that a color may not be largely altered.

The bezel width perceived by a user may be decreased and the color may not be largely altered when compensating the perceived luminance so that the display quality of the display panel 100 may be enhanced.

Figure 14:
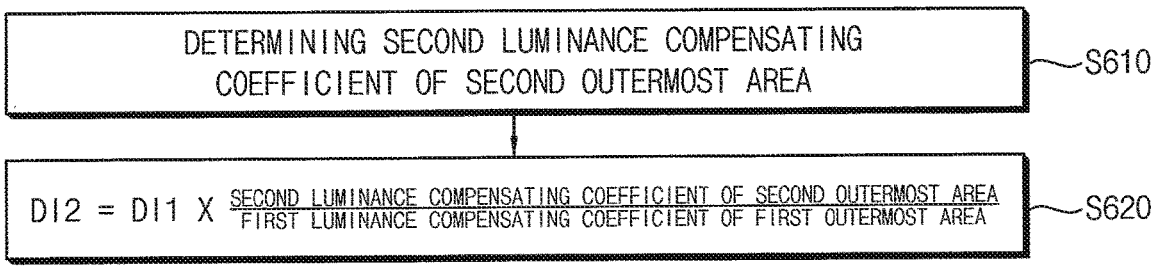
FIG. 14 is a flowchart illustrating a method of compensating a second outermost area of a display panel operated by an image compensator of a display apparatus according to an embodiment of the present inventive concept.

FIG. 14 is a flowchart illustrating a method of compensating a second outermost area of a display panel operated by an image compensator of a display apparatus according to an embodiment of the present inventive concept.

The display apparatus and the method of driving the display panel according to the present embodiment is substantially the same as the display apparatus and the method of driving the display panel of the previous embodiment explained referring to FIGS. 11 to 13 except for the method of compensating the input image data of the second outermost area. Thus, the same reference numerals will be used to refer to the same or like parts as those described in the previous embodiment of FIGS. 11 to 13 and any repetitive explanation concerning the above elements will be omitted.

Referring to FIGS. 1 to 5, 11 to 12C and 14, the image compensator 220 may determine a second luminance compensating coefficient X2 of the second outermost area OM2 of the display panel 100 (step S610). The second luminance compensating coefficient X2 may mean a compensation gain for compensation of the decrease of the luminance of the second outermost area OM2. The second luminance compensating coefficient X2 for compensation of the decrease of the luminance of the second outermost area OM2 may be less than the first luminance compensating coefficient X1 for compensation of the decrease of the luminance of the first outermost area OM1.

The image compensator 220 may determine the second compensation grayscale difference DI2 by multiplying ((the second luminance compensating coefficient X2)/(the first luminance compensating coefficient X1)) to the first compensation grayscale difference DI1 (step S620). When the first luminance compensating coefficient X1 is two and the second luminance compensating coefficient X2 is 1.333, the second compensation grayscale difference DI2 may be determined by multiplying 0.667 to the first compensation grayscale difference DI1.

In the present embodiment, the second compensation grayscale difference DI2 is determined not based on the subpixel grayscale values of the second outermost area OM2 but based on the ratio between the first luminance compensating coefficient X1 and the second luminance compensating coefficient X2 so that the second compensation grayscale difference DI2 may be determined more simply.

According to the present embodiment, the image data of the edge portion of the display panel 100 are compensated based on an actual decrease ratio of luminance of the edge portion of the display panel 100 so that the decrease of the luminance of the edge portion of the display panel 100 may be compensated.

In addition, when the decrease of the perceived luminance of the edge portion of the display panel 100 is compensated, the compensation grayscale difference DI1 and DI2 is determined using the maximum value of the grayscale values of the subpixels so that a color may not be largely altered.

The bezel width perceived by a user may be decreased and the color may not be largely altered when compensating the luminance so that the display quality of the display panel 100 may be enhanced.

The present inventive concept may be applied to a display apparatus and various apparatuses and systems including the display apparatus. The present inventive concept may be applied to various electronic devices such as a cellular phone, a smartphone, a PDA, a PMP, a digital camera, a camcorder, a PC, a server computer, a workstation, a laptop computer, a digital TV, a set-top box, a music player, a portable game console, a navigation system, a smart card, a printer and so on.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A display apparatus comprising:

a display panel configured to display an image;

a driving controller configured to generate a compensated image data for compensating a decrease of a luminance of an edge portion of the display panel based on input image data; and a data driver configured to output a data voltage to the display panel based on the compensated image data, wherein the driving controller is configured to generate the compensated image data by comparing a maximum value among subpixel grayscale values of the input image data to which a luminance compensating coefficient is applied and a maximum grayscale value of the input image data, wherein the luminance compensating coefficient is configured to be determined according to a location in the display panel, wherein the driving controller is configured to determine a first luminance compensating coefficient of a first outermost area of the display panel, to apply the first luminance compensating coefficient to subpixel grayscale values of the first outermost area, to determine a first maximum value which is a maximum value among the subpixel grayscale values of the first outermost area to which the first compensation coefficient is applied, and to compare the first maximum value and the maximum grayscale value of the input image data, and wherein, when the first maximum value is greater than the maximum grayscale value of the input image data, the driving controller is configured to determine a first compensation ratio as (the maximum grayscale value of the input image data)/(the first maximum value).

2. The display apparatus of claim 1, wherein, when the first maximum value is equal to or less than the maximum grayscale value of the input image data, the driving controller is configured to determine the first compensation ratio as 1.

3. The display apparatus of claim 2, wherein the driving controller is configured to multiply the first luminance compensating coefficient and the first compensation ratio to the subpixel grayscale values of the first outermost area to generate the compensated image data.

4. The display apparatus of claim 3, wherein the driving controller is configured to determine a second luminance compensating coefficient of a second outermost area of the display panel, to apply the second luminance compensating coefficient to subpixel grayscale values of the second outermost area, to determine a second maximum value which is a maximum value among the subpixel grayscale values of the second outermost area to which the second compensation coefficient is applied, and to compare the second maximum value and the maximum grayscale value of the input image data, and wherein the second outermost area of the display panel is adjacent to the first outermost area of the display panel and closer to a center of the display panel than the first outermost area.

5. The display apparatus of claim 4, wherein, when the second maximum value is greater than the maximum grayscale value of the input image data, the driving controller is configured to determine a second compensation ratio as (the maximum grayscale value of the input image data)/(the second maximum value).

6. The display apparatus of claim 5, wherein, when the second maximum value is equal to or less than the maximum grayscale value of the input image data, the driving controller is configured to determine the second compensation ratio as 1.

7. The display apparatus of claim 6, wherein the driving controller is configured to multiply the second luminance compensating coefficient and the second compensation ratio to the subpixel grayscale values of the second outermost area to generate the compensated image data.

8. The display apparatus of claim 3, wherein the driving controller is configured to determine a second luminance compensating coefficient of a second outermost area of the display panel, wherein the second outermost area of the display panel is adjacent to the first outermost area of the display panel and closer to a center of the display panel than the first outermost area, and wherein the driving controller is configured to determine a second compensation ratio by multiplying ((the second luminance compensating coefficient)/(the first luminance compensating coefficient)) to the first compensation ratio.

9. The display apparatus of claim 8, wherein the driving controller is configured to multiply the second luminance compensating coefficient and the second compensation ratio to the subpixel grayscale values of the second outermost area to generate the compensated image data.

10. A method of driving a display panel, the method comprising:

determining a luminance compensating coefficient for compensating a decrease of a luminance of an edge portion of the display panel;

comparing a maximum value among subpixel grayscale values of input image data to which the luminance compensating coefficient is applied and a maximum grayscale value of the input image data;

generating compensated image data based on a result of comparing the maximum value among subpixel grayscale values of input image data to which the luminance compensating coefficient is applied and the maximum grayscale value of the input image data; and outputting a data voltage to the display panel based on the compensated image data, wherein the luminance compensating coefficient is configured to be determined according to a location in the display panel, wherein a driving controller is configured to determine a first luminance compensating coefficient of a first outermost area of the display panel, to apply the first luminance compensating coefficient to subpixel grayscale values of the first outermost area, to determine a first maximum value which is a maximum value among the subpixel grayscale values of the first outermost area to which the first compensation coefficient is applied, and to compare the first maximum value and the maximum grayscale value of the input image data, and wherein, when the first maximum value is greater than the maximum grayscale value of the input image data, the driving controller is configured to determine a first compensation ratio as (the maximum grayscale value of the input image data)/(the first maximum value).

* * * * *